United States Patent [19]

Cornou

[11] 4,192,430

[45] Mar. 11, 1980

[54] LATERALLY OPENABLE STORAGE AND TRANSPORT BOX

[75] Inventor: Jean Cornou, Verrieres le Buisson, France

[73] Assignee: Allibert Exploitation, Societe Anonyme, Grenoble, France

[21] Appl. No.: 19,551

[22] Filed: Mar. 12, 1979

[51] Int. Cl.[2] ..... B65D 87/00

[52] U.S. Cl. ..... 220/1.5; 220/331

[58] Field of Search ..... 220/1.5, 331, 332, 334, 220/345

[56] References Cited

U.S. PATENT DOCUMENTS

| | | | |
|---|---|---|---|
| 2,579,655 | 12/1951 | Donald | 220/331 X |
| 3,860,138 | 1/1975 | Lovich et al. | 220/1.5 |
| 4,014,458 | 3/1977 | Berges | 220/1.5 X |

*Primary Examiner*—George T. Hall
*Attorney, Agent, or Firm*—Karl F. Ross

[57] ABSTRACT

A shipping, storage, and/or display box has a plurality of side walls extending upwardly from the box floor. One of these side walls has an upper portion formed between the respective corners with a window within which may fit a panel. A pair of double-axis hinge elements each have first portion journaled in the one wall adjacent the lower edge of the window for pivoting about a first axis and a second portion journaled in the panel for pivoting about a second axis generally parallel to and offset from the first axis. These hinges let the panel lie flat against the lower portion of the respective side when in the open condition, yet ensure that the entire hinge arrangement will lie inside a plane defined by the outer surface of the respective side when the panel is closed.

10 Claims, 5 Drawing Figures

LATERALLY OPENABLE STORAGE AND TRANSPORT BOX

FIELD OF THE INVENTION

The present invention relates to a storage container. More particularly this invention concerns a laterally openable storage box.

BACKGROUND OF THE INVENTION

It is standard practice to transport and store various goods in crates or boxes having a closed lower wall or floor, closed side walls, and an open upper wall or top which may be covered with a lid. So long as the top of such a box is readily accessible it is easy to remove items stored therein from the box. When, however, such boxes are stacked, it is impossible to gain access to the interiors of any but the uppermost box without moving the boxes on top of the box containing the desired item.

It has been suggested to provide such a storage and transport box which can be stacked on its side, so that in effect the top is provided on the side. This arrangement has the considerable disadvantage that when loose items, such as produce, are held within such a box they can all come cascading out when the lid is removed laterally. What is more it is normally impossible to close such an arrangement.

Although it has been suggested to provide laterally openable doors on such boxes, as on an air-freight container, such arrangements normally are considered undesirable for several reasons.

First of all such a door normally causes considerable structural weakening of the box, often to the point where it can no longer meet prescribed strength specifications. What is more such a laterally openable door normally projects outwardly when opened, or at least its hinge projects beyond the plane of the outer surface of the side having such a door, so that the provision of this door, even when it is closed, makes handling and shipping of such a box rather difficult.

OBJECTS OF THE INVENTION

It is therefore an object of the present invention to provide an improved shipping and/or transport box.

Another object is to provide such a box which has an open top that may be closed by a lid, but which nonetheless allows lateral access to the contents of the box even when such a box is at a position other than the top of a stack of such boxes.

A further object is to provide such a laterally openable box which is compact when laterally closed and when laterally open, and which has good strength when closed.

SUMMARY OF THE INVENTION

These objects are attained according to the instant invention in a box having a floor and a plurality of side walls extending upwardly from this floor and joined together at vertically extending corners. One of these side walls has an upper portion formed between the respective corners with a window having a lower edge and a pair of side edges. According to this invention a panel dimensioned to fit within and substantially close this window is secured to the respective wall by at least one double-axis hinge element having a first portion journaled in the one wall adjacent the lower edge thereof for pivoting about a first axis and having a second portion journaled in the panel for pivoting about a second axis generally parallel to and offset from the first axis. These axes are sufficiently spaced that the panel can move between a closed position flush with the one wall and blocking the window and a second position lying generally flatly against the one wall below the window.

According to this invention the one side wall and the panel have substantially coplanar outer surfaces in the closed position of the panel. The hinge element and the axes defined thereby lie wholly to the inside of the plane of these surfaces in the closed position. That is in the closed position of the panel no portion of the hinge projects laterally outwardly beyond the plane defined by the outer surfaces of the panel and of the one side wall. Thus the provision of this openable panel does not encumber the box with laterally outwardly projecting hinges that prevent the boxes from lying flatly and laterally against each other when stored or transported. At the same time when the panel is open it lies flatly against the respective side wall, so that it does not itself constitute an obstruction. This last-mentioned feature is combined with the feature that the one wall has a height below the window that is greater than the height of the panel, so that in a stack of such boxes all of the panels can be open and no one panel will hang down below the underlying box. What is more loose contents in such a box will be largely confined by the one wall below the open panel so that even if, for instance, potatoes are stored in the box they will not come tumbling out as soon as the panel is opened, but will be well contained and easily accessible.

According to further features of this invention the panel is attached by two such hinge elements to the one side wall. Each of these hinge elements is constituted as a U-shaped rod having first and second legs respectively corresponding to the first and second portions and a straight bight interconnecting these legs. Each first leg is received within a respective cylindrical hole in the respective side edge of the window. Each second leg is received, however, within an elongated slot in the panel.

In accordance with another feature of this invention, particularly useful in combination with the above-described slots, the outer edges of the panel are each provided with at least one outwardly projecting formation. Similarly the side edges of the window are each formed with a respective L-shaped groove. Each projection is receivable within a respective one of the grooves, and the displaceability of the panel relative to the second leg of the hinge element allows the projections to move along the legs of the L, so that the panel can be locked in place. In the closed position of the panel its upper edge lies flush with the top of the box. Thus when such boxes are stacked together, and they are normally formed with mating tops and bottoms so that such a stack is stable, they cannot be opened. It is possible, however, to open each box up before another box is stacked on top of it, so as to form a sturdy stack where nonetheless one can gain access to each and every box of the stack.

SPECIFIC DESCRIPTION

Figure 1:
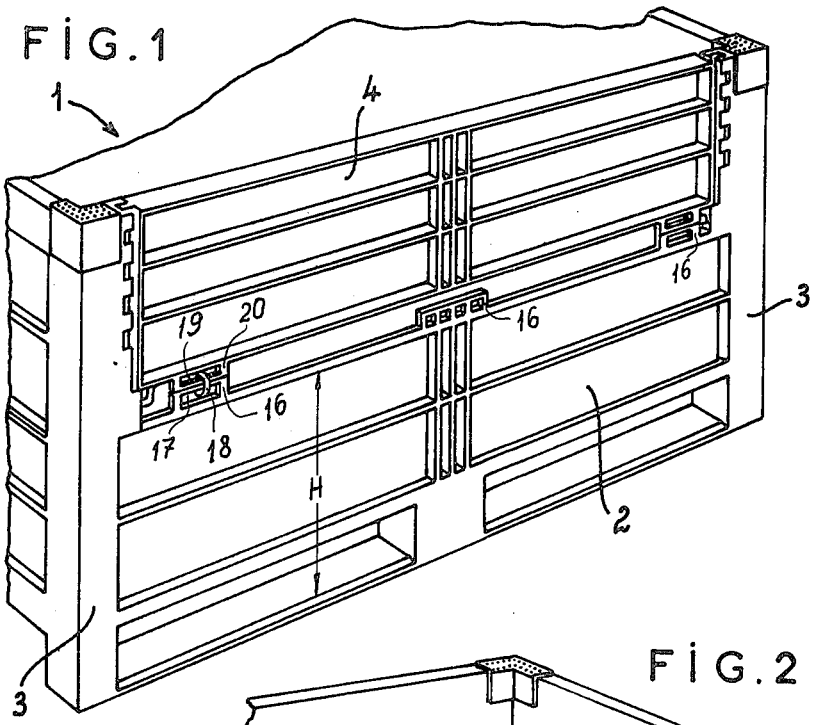
FIGS. 1 and 2 are perspective views of the box according to this invention in the open and closed position, respectively.
Figure 2:
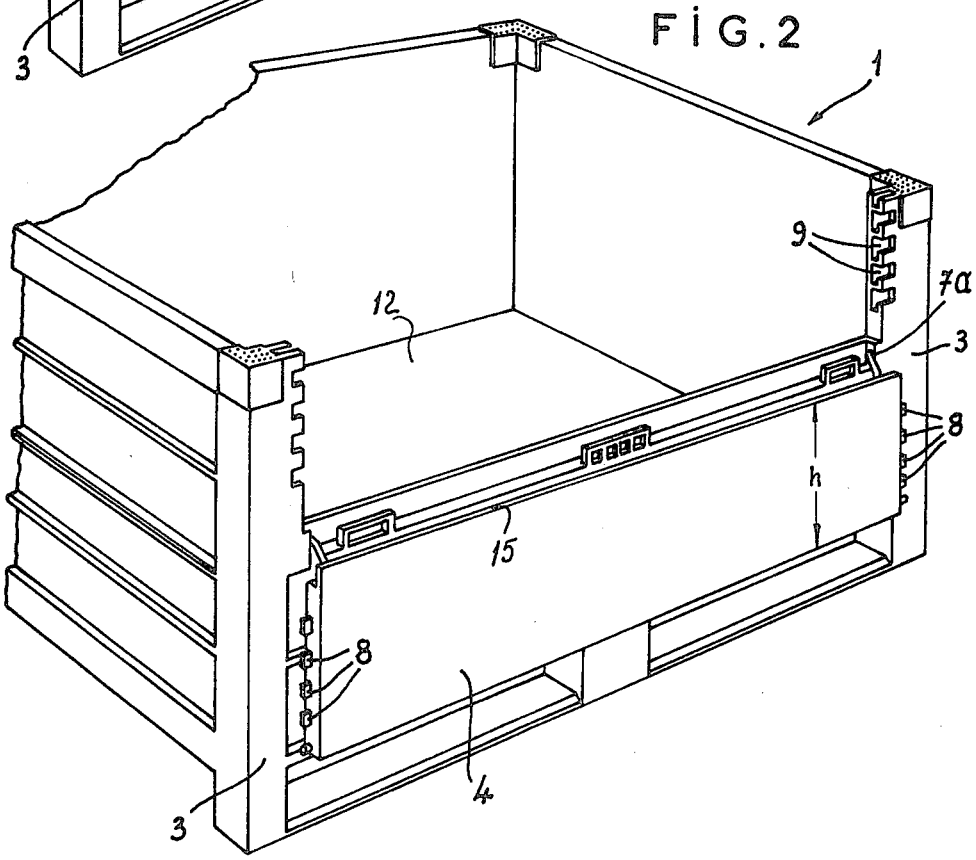

A box 1 according to the invention has as shown in FIGS. 1 and 2 a floor 12 and a plurality of side walls 13 meeting at corners 3. One of these side walls is formed of a lower portion 2 and an upper portion or panel 4. All four of the walls could be thus formed in accordance with the invention. The entire box 1 is cast of a rugged synthetic-resin material such as polyethylene or closed-cell polyurethane. The sides 13 are ribbed for strength and the corners 3 are constituted as rigid stiffening posts. In addition the lower surface of the floor 12 of the box is dimensioned to fit within the top of another box of identical construction so that the boxes can be set on top of one another to form a stable stack.

Figure 3:
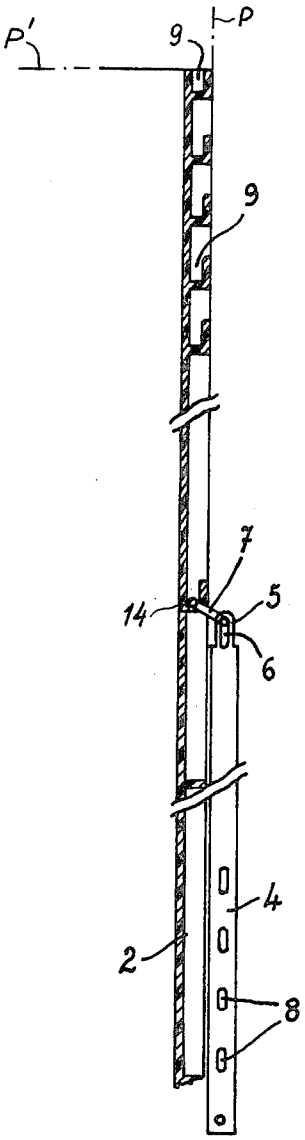
FIGS. 3, 4 and 5 are vertical sections through the box according to this invention showing the panel in the open, partially closed, and fully closed positions, respectively.

As also shown in FIG. 3 the panel 4 has a lower edge 5 connected by means of a pair of double-axis U-shaped hinge elements 7 to the upper edge 14 of the lower portion 2 of the respective side 13. Each of these U-shaped hinge elements 7 has a first leg 7*a* journaled in a cylindrical hole in the respective corner post 3 and another leg 7*b* received within a slot 6 of the panel 4. The legs 7*a* of the two elements 7 are coaxial with each other and the portions 7*b* are similarly coaxial with each other but offset from and parallel to the portions 7*a*.

In addition the panel 4 has outer edges each formed with a plurality of outwardly projecting formations 8 receivable within respective L-shaped grooves 9 of the respective side edge of the window in which the panel 4 is received.

Figure 5:
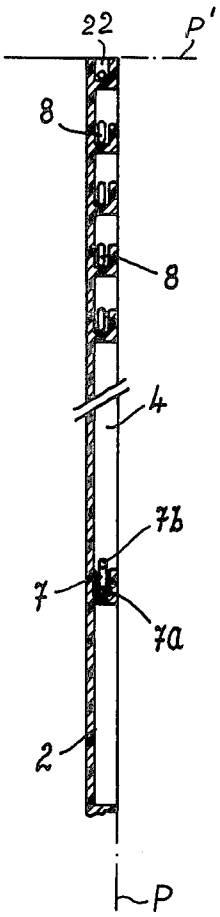

Furthermore the lower edge of the panel 4 is formed with a lip 15 (FIG. 2) that can engage behind tabs 16 of the upper edge 14 of the lower portion 2. In the closed position shown in FIGS. 1 and 5 the outer surfaces of the panel 4 and of the lower portion 2 define a plane P within which both of the elements 7 lie.

During filling or emptying of the box 1 the panel 4 lies in the open position shown in FIGS. 2 and 3. As can be seen here the panel 4, which has an overall height h substantially shorter than the height H (FIGS. 1 and 2) of the portion 2, lies flatly against the portion 2. In this position the legs 7*a* of the elements 7 lie to one side of the plane P and the legs 7*b* to the other.

Figure 4:
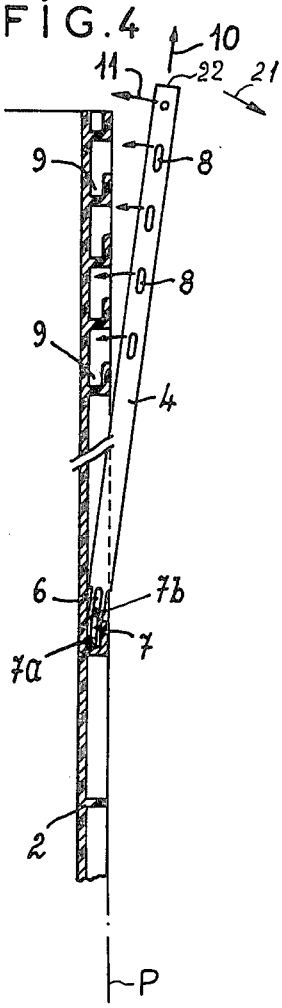

In order to close the box laterally the panel is swung up in the direction of arrow 11 of FIG. 4 and is simultaneously pulled upwardly in the direction of arrow 10. In this position the projections 8 can fit within the upper horizontally opening legs of the grooves 9. Once the panel 4 lies wholly within the plane P it can be pushed down in the direction opposite that of FIG. 4 so as to lock the projections 8 within the grooves 9 and to lock the lip 15 behind the formations 16. In this position no structure of the box or hinge lies outside the plane P. At the same time the rigid interconnection of the panel 4 with the box 1 imparts considerable strength to this box 1, so that accidental opening is unlikely. What is more in this position the upper edge 22 of the panel 4 lies exactly flush with the plane P′ of the rim of the box 1, so that if another such box 1 is fitted onto it this overlying box 1 will effectively prevent opening of the panel 4. Such opening can also be effectively prevented by placing a wire or clip such as shown at 18 through a hole 17 in one of the tabs 16 and through another such hole 19 in a tab 20 formed on the lower edge of the panel 4.

It is possible to ship goods in such boxes 1 with the side panels 4 in a closed position. When received by the dealer the panels 4 are opened up by lifting them upwardly in the direction 10 and pulling them outwardly in a direction 21 opposite the direction 11 so that they flop down flat against the lower portion 2 of the side 13. In this open position of the panels 4 the boxes can be stacked one atop the other so as to form a neat stock arrangement or display. Goods can be taken from any of these boxes 1, and the smooth inner surface of the panel 4 is ideally suited for carrying information about the goods in the respective box 1, as for example prices. Thus the box 1 according to this invention is a rigid, sturdy and practical shipping container which when fully closed represents a neat unit having no problem-causing projections on its outside. At the same time one of the sides can be opened, and left open when the boxes are stacked together, so that transferring the goods to shelves is not necessary.

What is claimed is:

1. A box comprising:

a floor;

a plurality of side walls extending upwardly from said floor and joined together at vertically extending corners, one of said side walls having an upper portion formed between the respective corners with a window having a lower edge and a pair of side edges;

a panel dimensioned to fit within and substantially close said window; and at least one double-axis hinge element having a first portion journaled in said one wall adjacent said lower edge for pivoting about a first axis and having a second portion journaled in said panel for pivoting about a second axis generally parallel to and offset from said first axis, said axes being sufficiently spaced that said panel can move between a closed position flush with said one wall and blocking said window and a second position lying generally flatly against said one wall below said window.

2. The box defined in claim 1 wherein said one side wall and panel have substantially coplanar outer surfaces in said closed position of said panel, said element and said axes lying wholly to the inside of the plane of said surfaces in said closed position.

3. The box defined in claim 2 wherein said first axis lies within said plane in said open and closed positions.

4. The box defined in claim 1, further comprising another such element having first and second portions coaxial with the portions of the first-mentioned elements and axially spaced therefrom.

5. The box defined in claim 4 wherein each of said elements is substantially U-shaped and has a pair of legs each constituting a respective portion.

6. The box defined in claim 1 wherein said panel is formed with an elongated slot receiving and along which is movable said second portion.

7. The box defined in claim 6 wherein said panel has outer edges alignable with said side edges in said closed position, said side edges each being formed with at least one L-shaped groove open toward said panel, said panel having at each of its outer edges at least one outwardly projecting formation engageable in the respective grooves.

8. The box defined in claim 1 wherein said one wall has a height below said window that is greater than the height of said panel, whereby the upper edge of said panel in said open position lies above the bottom of said box.

9. The box defined in claim 1 wherein said walls and floor form an upwardly open container with a rim lying substantially in a plane, said panel having an upper edge lying substantially in said plane in said closed position, said panel having outer edges alignable with said side edges in said closed position, said side edges each being formed with at least one L-shaped groove open toward said panel, said panel having at each of its said outer edges at least one outwardly projecting formation engageable in the respective grooves.

10. The box defined in claim 9 wherein said panel is formed with a slot extending generally in the plane of said panel and receiving said second portion for displacement of said panel generally parallel to said slot relative to said element, said L-shaped grooves each having one horizontally outwardly extending and opening leg and one vertical leg terminating at its upper end at the respective horizontal leg.

* * * * *